US011434632B1

(12) United States Patent
Irion

(10) Patent No.: US 11,434,632 B1
(45) Date of Patent: Sep. 6, 2022

(54) AUTOMATIC TOILET CLEANING APPARATUS

(71) Applicant: James M. Irion, Sun City, AZ (US)

(72) Inventor: James M. Irion, Sun City, AZ (US)

( * ) Notice: Subject to any disclaimer, the term of this patent is extended or adjusted under 35 U.S.C. 154(b) by 0 days.

(21) Appl. No.: 17/356,661

(22) Filed: Jun. 24, 2021

(51) Int. Cl.
*E03D 9/03* (2006.01)
*E03D 9/02* (2006.01)

(52) U.S. Cl.
CPC ..... *E03D 9/037* (2013.01); *E03D 2009/028* (2013.01)

(58) Field of Classification Search
CPC ..... E03D 9/037; E03D 2009/028
USPC ..... 4/227.1
See application file for complete search history.

(56) References Cited

U.S. PATENT DOCUMENTS 2,726,406 A * 12/1955 Vierra ..... E03D 9/037 4/227.3
2,807,807 A * 10/1957 Harper ..... E03D 9/038 134/22.16
3,545,014 A * 12/1970 Elbert ..... E03D 9/038 4/227.1
4,491,988 A * 1/1985 Mizuno ..... E03D 9/037 4/227.3
4,534,071 A * 8/1985 Russomanno ..... E03D 9/037 4/227.3
4,660,231 A * 4/1987 McElfresh ..... E03D 9/037 222/64
4,696,414 A * 9/1987 Huat ..... E03D 9/037 222/363
4,760,612 A * 8/1988 Dufau ..... E03D 9/037 4/225.1
6,374,426 B1 * 4/2002 Falchieri ..... E03D 9/037 4/227.2
6,496,987 B1 * 12/2002 Chou ..... E03D 9/037 4/227.3
6,944,890 B1 * 9/2005 Sim ..... E03D 9/037 4/225.1
2003/0226198 A1 * 12/2003 Harbutt ..... E03D 9/037 4/227.1
2004/0194196 A1 * 10/2004 Muderlak ..... E03D 9/037 4/225.1
2005/0172383 A1 * 8/2005 Navon ..... E03D 9/007 4/227.1
2007/0214554 A1 * 9/2007 Slade ..... E03D 9/037 222/188
2007/0240253 A1 * 10/2007 Eshel ..... E03D 9/037 4/227.1
2011/0209277 A1 * 9/2011 Liu ..... E03D 9/033 4/227.1

* cited by examiner

*Primary Examiner* — Benjamin R Shaw
(74) *Attorney, Agent, or Firm* — Bruce A. Lev

(57) ABSTRACT

An automatic toilet cleaning apparatus that discharges cleaning fluid into the water of a tank of a toilet during each flush. The apparatus includes a container having an extendable bladder therein that successively fills with water during each flush thereby successively pushing out a small amount of cleaning fluid into the water of the toilet tank to clean the bowl of the toilet.

20 Claims, 2 Drawing Sheets

AUTOMATIC TOILET CLEANING APPARATUS

CROSS-REFERENCE TO RELATED APPLICATION

There are no related applications incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This invention relates generally to automatic toilet cleaning apparatuses.

2. Description of the Related Art

Many prior art toilet cleaners have been formed as simple tablets of chemicals placed within the water tank of a toilet mechanism that slowly dissolve into the water. Other types include containers placed within the toilet tanks that take in water and force out cleaning fluid, however the cleaning fluid inside the container successively intermixes with the tank water and the cleaning fluid becomes diluted and less potent after each flush. The instant invention overcomes this particular problem by including a bladder and dividing the toilet tank water from the cleaning fluid within the container of the automatic toilet cleaner.

BRIEF SUMMARY OF THE INVENTION

In view of the foregoing disadvantages inherent in the known types of toilet cleaners or like in the prior art, the present invention provides an automatic toilet cleaning apparatus that discharges cleaning fluid into the water of a tank of a toilet during each flush. The apparatus includes a container having an extendable bladder therein that successively fills with water during each flush thereby successively pushing out a small amount of cleaning fluid into the water of the toilet tank to clean the bowl of the toilet.

As such, the general purpose of the present invention, which will be described subsequently in greater detail, is to provide an automatic toilet cleaning apparatus with all the advantages of the prior art and none of the disadvantages.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

The figures which accompany the written portion of this specification illustrate embodiments according to the teachings of the present invention.

The various embodiments of the present invention will hereinafter be described in conjunction with the appended drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

Figure 1:
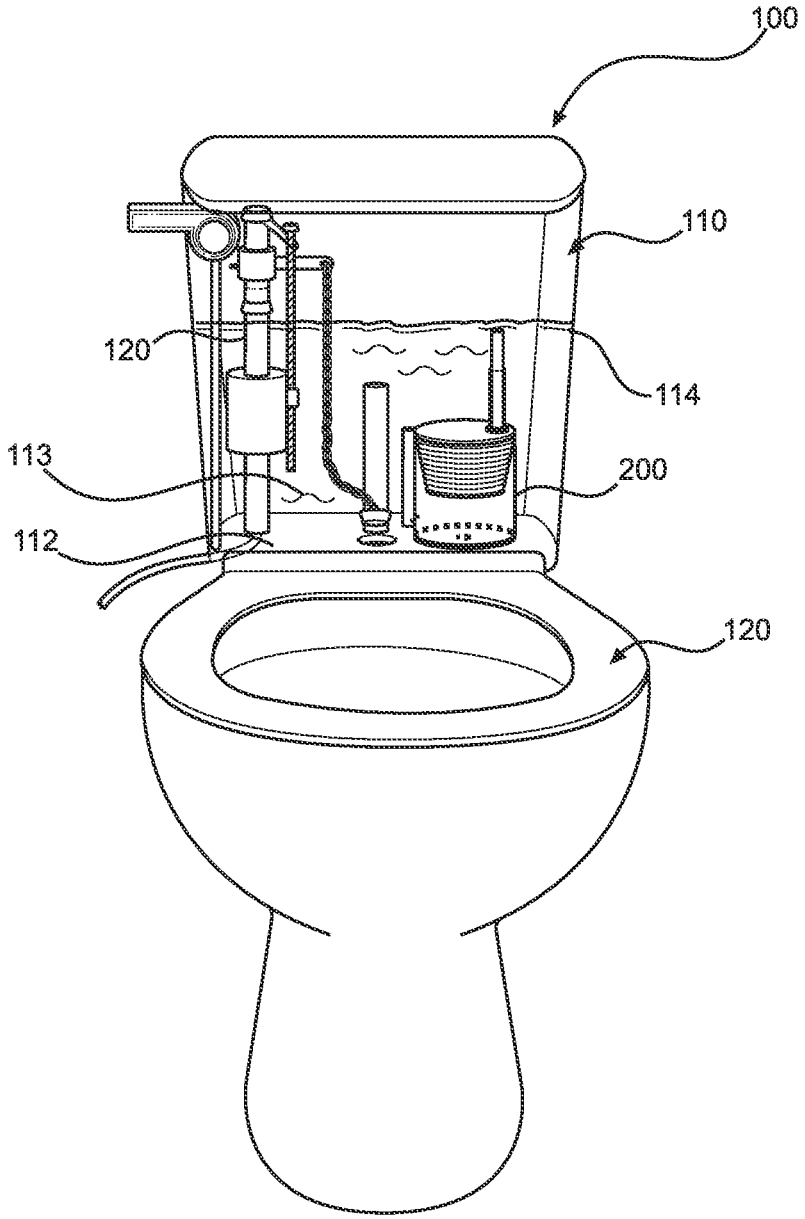
FIG. 1 shows a perspective view of the automatic toilet cleaner placed within a water tank of a toilet apparatus according to the preferred embodiment of the present invention.
Figure 2:
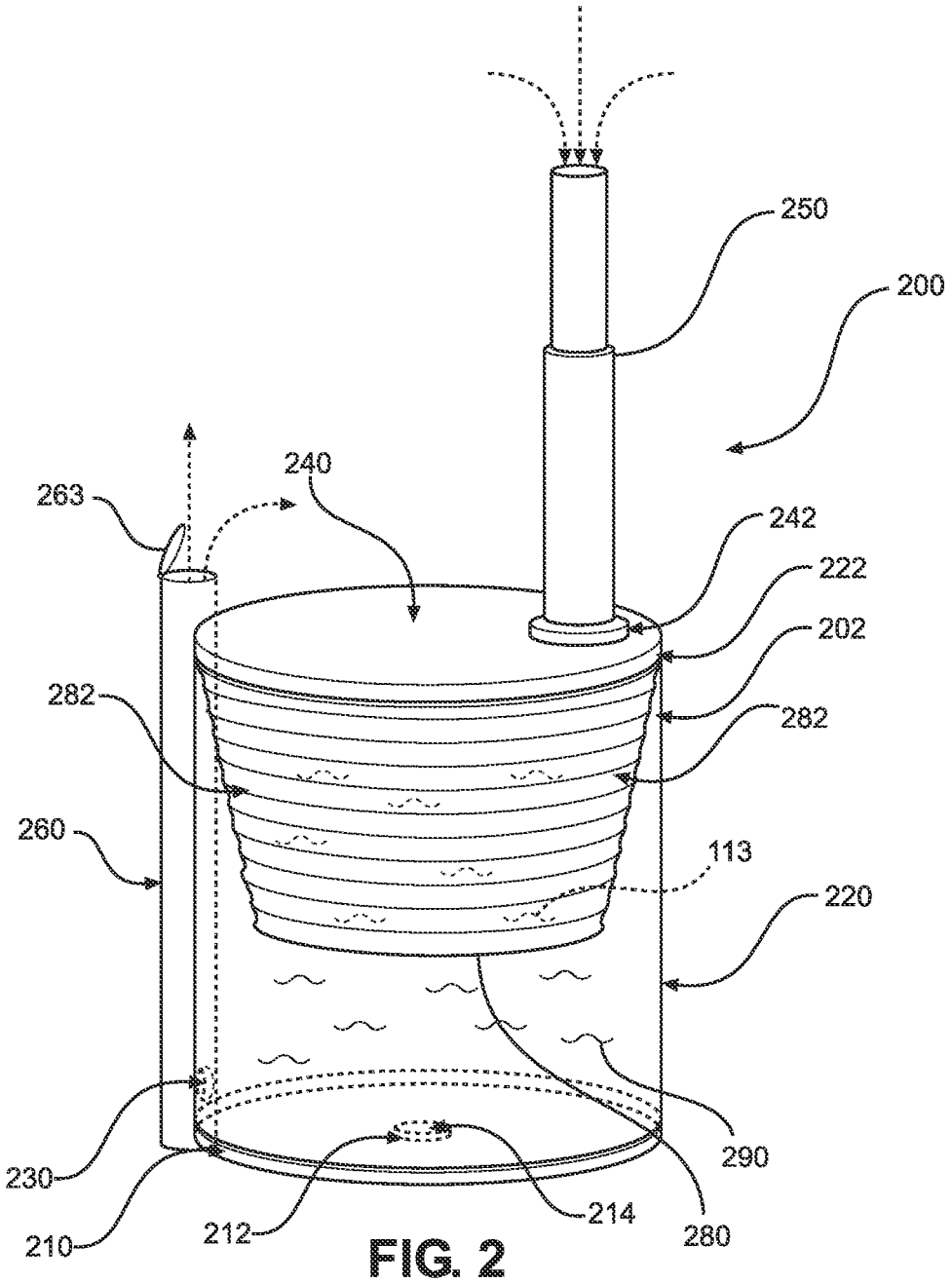
FIG. 2 shows a perspective view of the automatic toilet cleaner according to the preferred embodiment of the present invention of FIG. 1.

Turning now descriptively to drawing, referring to FIGS. 1-2, the present invention discloses an automatic toilet cleaner 200 for use in a toilet tank 110 to automatically clean a toilet bowl 120 of a toilet apparatus 100. Most toilets include a toilet bowl 120 attached to a toilet tank 110 that has a bottom wall 112 and at least one side wall 114, wherein the at least one side wall is connected to and extends upwardly from the bottom wall, wherein the bottom wall and the at least one side wall form an interior volume, and a fluid master 120, wherein the fluid master is adapted to allow water 113 to fill the interior volume to a desired level, and allow the water to drain from the toilet tank when desired and be refilled, and wherein the water from the toilet tank is adapted to flow into the toilet bowl.

The instant invention includes of an automatic toilet cleaner 200 comprising a container 202 comprising a bottom wall 210, at least one side wall 220 including a discharge aperture 230, wherein the at least one side wall is connected to and extends upwardly from the bottom wall, wherein the at least one side wall forms a top rim 222 spaced from the bottom wall, and wherein the discharge aperture is located in proximity to the bottom wall; a lid 240 including an intake aperture 242, wherein the lid is removably connected to the top rim; wherein the bottom wall, the at least one side wall, and the removable lid define an interior volume; an intake tube 250 connected to the intake aperture and extends a predetermined distance from the lid, and is adapted to allow water from a toilet tank to flow into the interior volume of the container; a discharge tube 260 connected to the discharge aperture, and is adapted to allow cleaning fluid to flow outwardly from the interior volume of the container; a bladder 280 located within the interior volume of the container, and is held in place by and in between the at least one side wall and the top lid along the top rim; and cleaning fluid 290 placed within the interior volume and in between the bottom wall, the at least one side wall, and below the bladder; wherein the automatic toilet cleaner 200 is adapted such that when it is placed in the water 113 within a toilet tank 110 of a toilet apparatus 100 water can flow through the intake tube 250 and into the interior volume of the container 202 in between the top lid, the at least one side wall, and above the bladder thereby creating a downward force upon the bladder 280, which in turn forces a portion of the cleaning fluid to flow outwardly from the discharge tube and into the water of the toilet tank upon each flush of the toilet. The discharge tube may further include a pivoting flapper 263 that allows the cleaning fluid 290 to exit the discharge tube 260, however, will cover the opening of the discharge tube, via gravity, after cleaning fluid has exited and prevent toilet tank water from entering thereafter. As such, this will prevent the cleaning fluid within the container 202 from being diluted by any incoming toilet tank water.

The at least one side wall of the automatic toilet cleaner can be curved, such that the container 280 forms a cylindrical volume.

The bottom wall 210 of the automatic toilet cleaner container 202 includes a cleaning fluid aperture 212 therethrough, and a removable plug 214 removably placed within the cleaning fluid aperture, wherein cleaning fluid 290 can be inserted, and the automatic toilet cleaner refilled, through the cleaning fluid aperture and into the interior volume in between the bottom wall, the at least one side wall, and below the flexible diaphragm.

The cleaning fluid 290 may be formed from chemicals and compounds chosen from a group of chemicals and compounds consisting of chlorine, carboxylic acid, glycolic acid, hydrochloric acid, citric acid, baking soda, an acrylic copolymer, salt, bleach, formaldehyde, and vinegar. The container 202 may be formed from a material chosen from a group of materials consisting of plastic, acrylic, stainless steel, copper, and rubber. And, the bladder 280 may formed from a material chosen from a group of materials consisting of plastic, elastomers, polytetrafluoroethylene, and rubber.

The bladder 280 is formed as being extendable and adapted such that upon successive flushes of the toilet more and more water enters the container thereby extending the bladder, which successively forces more cleaning fluid outwardly from the discharge tube and into the water of the toilet tank. The bladder 280 may include folded side walls 282 acting in an accordion-like fashion and are adapted to expand as the bladder is successively filled by the water of the toilet tank.

The bladder 280 can be held in place in between the at least one side wall and the top lid along the top rim by interdigitating threads placed upon the at least one side wall and the top rim of the lid, or it can be glued in between, or by other known ways and means.

In use, the automatic toilet cleaner 200 is placed in the water 113 of the toilet tank and upon the bottom wall 112 thereof. The distal end of the intake tube 250 should be positioned below the waterline of the water inside the toilet tank. The length of the intake tube can be adjusted to accomplish this by snapping it, or cutting it, or by being forming it from two telescoping tubes. The rest of the automatic toilet cleaner 200, including the distal end of the discharge tube 260 is also positioned below the waterline of the water inside the toilet tank. When the toilet is flushed, water can flow through the intake tube 250 and into the interior volume of the container in between the top lid, the at least one side wall, and above the bladder 280 thereby creating a downward force upon the bladder, which in turn forces a portion of the cleaning fluid 290 to flow outwardly from the discharge tube 260 and into the water 113 of the toilet tank 110 upon each flush of the toilet.

The automatic toilet cleaner 200 may be reusable as well. Once all or most of the cleaning fluid has been exhausted, the unit can be removed from the toilet tank, the lid 240 removed, the toilet water drained from the bladder 280, and the lid replaced thereon. From there, plug 214 can be removed, more cleaning fluid inserted into the container 202 through cleaning fluid aperture 212, and the plug 214 screwed back into the cleaning fluid aperture 212. Then the automatic toilet cleaner 200 is ready to be placed back into a toilet tank.

One of the advantages of the instant invention over previous types of toilet cleaners placed within the water tank of a toilet is that the cleaning fluid is not mixing with the water of the toilet tank until it is discharged into the water. In this way, the cleaning fluid discharged into the water is always at its maximum strength. Previous types and designs of toilet cleaners either become diluted after each flush or become dissolved and less potent after each flush as the water from the tank enters their respective containers and intermixes with the cleaning fluid. The instant invention overcomes this particular problem by including the bladder and dividing the toilet tank water from the cleaning fluid within the container of the automatic toilet cleaner.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. An automatic toilet cleaner comprising:

a container comprising:

a bottom wall;

at least one side wall including:

a discharge aperture;

wherein said at least one side wall is connected to and extends upwardly from said bottom wall; and wherein said at least one side wall forms a top rim spaced from said bottom wall;

wherein said discharge aperture is located in proximity to said bottom wall;

a lid including:

an intake aperture;

wherein said lid is removably connected to said top rim;

wherein said bottom wall, said at least one side wall, and said removable lid define an interior volume;

an intake tube;

wherein said intake tube is connected to said intake aperture and extends a predetermined distance from said lid, and is adapted to allow water from a toilet tank to flow into said interior volume of said container;

a discharge tube;

wherein said discharge tube is connected to said discharge aperture, and is adapted to allow cleaning fluid to flow outwardly from said interior volume of said container;

a bladder;

wherein said bladder is located within said interior volume of said container, and is held in place by and in between said at least one side wall and said top lid along said top rim; and cleaning fluid;

wherein said cleaning fluid is placed within said interior volume and in between said bottom wall, said at least one side wall, and below said bladder;

wherein said automatic toilet cleaner is adapted such that when it is placed in the water within a toilet tank of a toilet water can flow through said intake tube and into said interior volume of said container in between said top lid, said at least one side wall, and above said bladder thereby creating a downward force upon said bladder, which in turn forces a portion of said cleaning fluid to flow outwardly from said discharge tube and into the water of said toilet tank upon each flush of said toilet.

2. The automatic toilet cleaner of claim 1, wherein said at least one side wall is curved, such that said container forms a cylindrical volume.

3. The automatic toilet cleaner of claim 1, wherein said bottom wall includes a cleaning fluid aperture therethrough; and a removable plug removably placed within said cleaning fluid aperture; wherein said cleaning fluid can be inserted through said cleaning fluid aperture and into said interior volume in between said bottom wall, said at least one side wall, and below said bladder.

4. The automatic toilet cleaner of claim 1, wherein said cleaning fluid is formed from chemicals and compounds chosen from a group of chemicals and compounds consisting of chlorine, carboxylic acid, glycolic acid, hydrochloric acid, citric acid, baking soda, an acrylic copolymer, salt, bleach, formaldehyde, and vinegar.

5. The automatic toilet cleaner of claim 1, wherein said container is formed from a material chosen from a group of materials consisting of plastic, acrylic, stainless steel, copper, and rubber.

6. The automatic toilet cleaner of claim 1, wherein said bladder is formed from a material chosen from a group of materials consisting of plastic, elastomers, polytetrafluoroethylene, and rubber.

7. The automatic toilet cleaner of claim 1, wherein said discharge tube extends upwardly adjacent said at least one side wall, and is adapted to allow said cleaning fluid to flow outwardly from said discharge tube and into the water of said toilet tank at a position adjacent said lid.

8. The automatic toilet cleaner of claim 1, wherein said bladder is extendable and adapted such that upon successive flushes of said toilet more and more water enters said container thereby extending said bladder, which successively forces more cleaning fluid outwardly from said discharge tube and into the water of said toilet tank.

9. The automatic toilet cleaner of claim 8, wherein said bladder includes folded side walls adapted to expand as the bladder is successively filled by said water of said toilet tank.

10. The automatic toilet cleaner of claim 7, wherein said discharge tube includes a pivoting flapper on a distal end thereof adapted to allow said cleaning fluid to exit said discharge tube, and then cover said discharge tub via gravity after said cleaning fluid has exited, such that water from said toilet tank is prevented from entering said discharge tube thereafter.

11. A combination of a toilet and an automatic toilet cleaner, comprising:

a toilet including:

a toilet bowl; and a toilet tank including:

a bottom wall; and at least one side wall;

wherein said at least one side wall is connected to and extends upwardly from said bottom wall;

wherein said bottom wall and said at least one side wall form an interior volume; and a fluid master;

wherein said fluid master is adapted to allow water to fill said interior volume to a desired level, and allow said water to drain from said toilet tank when desired and be refilled;

wherein said toilet tank is attached to said toilet bowl; and wherein said water from said toilet tank is adapted to flow into said toilet bowl; and an automatic toilet cleaner comprising:

a container comprising:

a bottom wall;

at least one side wall including:

a discharge aperture;

wherein said at least one side wall is connected to and extends upwardly from said bottom wall; and wherein said at least one side wall forms a top rim spaced from said bottom wall;

wherein said discharge aperture is located in proximity to said bottom wall;

a lid including:

an intake aperture;

wherein said lid is removably connected to said top rim;

wherein said bottom wall, said at least one side wall, and said removable lid define an interior volume;

an intake tube;

wherein said intake tube is connected to said intake aperture and extends a predetermined distance from said lid, and is adapted to allow water from a toilet tank to flow into said interior volume of said container;

a discharge tube;

wherein said discharge tube is connected to said discharge aperture, and is adapted to allow cleaning fluid to flow outwardly from said interior volume of said container;

a bladder;

wherein said bladder is located within said interior volume of said container, and is held in place by and in between said at least one side wall and said top lid along said top rim; and cleaning fluid;

wherein said cleaning fluid is placed within said interior volume and in between said bottom wall, said at least one side wall, and below said bladder;

wherein said automatic toilet cleaner is adapted such that when it is placed in the water within a toilet tank of a toilet water can flow through said intake tube and into said interior volume of said container in between said top lid, said at least one side wall, and above said bladder thereby creating a downward force upon said bladder, which in turn forces a portion of said cleaning fluid to flow outwardly from said discharge tube and into the water of said toilet tank upon each flush of said toilet.

12. The combination of claim 11, wherein said at least one side wall is curved, such that said container forms a cylindrical volume.

13. The combination of claim 11, wherein said bottom wall includes a cleaning fluid aperture therethrough; and a removable plug removably placed within said cleaning fluid aperture;

wherein said cleaning fluid can be inserted through said cleaning fluid aperture and into said interior volume in between said bottom wall, said at least one side wall, and below said bladder.

14. The combination of claim 11, wherein said cleaning fluid is formed from chemicals and compounds chosen from a group of chemicals and compounds consisting of chlorine, carboxylic acid, glycolic acid, hydrochloric acid, citric acid, baking soda, an acrylic copolymer, salt, bleach, formaldehyde, and vinegar.

15. The combination of claim 11, wherein said container is formed from a material chosen from a group of materials consisting of plastic, acrylic, stainless steel, copper, and rubber.

16. The combination of claim 11, wherein said bladder is formed from a material chosen from a group of materials consisting of plastic, elastomers, polytetrafluoroethylene, and rubber.

17. The combination of claim 11, wherein said discharge tube extends upwardly adjacent said at least one side wall, and is adapted to allow said cleaning fluid to flow outwardly from said discharge tube and into the water of said toilet tank at a position adjacent said lid.

18. The combination of claim 11, wherein said bladder is extendable and adapted such that upon successive flushes of said toilet more and more water enters said container thereby extending said bladder, which successively forces more cleaning fluid outwardly from said discharge tube and into the water of said toilet tank.

19. The combination of claim 18, wherein said bladder includes folded side walls adapted to expand as the bladder is successively filled by said water of said toilet tank.

20. The automatic toilet cleaner of claim 17, wherein said discharge tube includes a pivoting flapper on a distal end thereof adapted to allow said cleaning fluid to exit said discharge tube, and then cover said discharge tub via gravity after said cleaning fluid has exited, such that water from said toilet tank is prevented from entering said discharge tube thereafter.

* * * * *